US006578221B2

(12) United States Patent
Ping

(10) Patent No.: US 6,578,221 B2
(45) Date of Patent: Jun. 17, 2003

(54) FOLDABLE MULTI-TOOL

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 09/818,469

(22) Filed: Mar. 28, 2001

(65) Prior Publication Data

US 2002/0138913 A1 Oct. 3, 2002

(51) Int. Cl.[7] ..... B25B 7/22
(52) U.S. Cl. ..... 7/128
(58) Field of Search ..... 7/125, 127, 128, 7/118

(56) References Cited

U.S. PATENT DOCUMENTS

| | | | |
|---|---|---|---|
| 154,750 | A | 8/1874 | Flack et al. |
| 237,138 | A | 2/1881 | Slayton |
| 266,073 | A | 1/1882 | Austin |
| 295,885 | A | 3/1884 | Pullman |
| 310,439 | A | 1/1885 | Kamak |
| 337,858 | A | 3/1886 | Neuhaus |
| 358,312 | A | 2/1887 | Weck |
| 445,509 | A | 1/1891 | Thayer |
| 464,405 | A | 12/1891 | Widmann |
| 515,828 | A | 3/1894 | Haydan |
| 542,601 | A | 7/1895 | Baker |
| 580,235 | A | 4/1897 | Strum |
| 589,392 | A | 7/1897 | Kolar |
| 592,766 | A | 11/1897 | Effinger et al. |
| 596,096 | A | 12/1897 | Watts |
| 614,537 | A | 11/1898 | Dahlquist |
| 649,334 | A | 5/1900 | Meloos |
| 662,005 | A | 11/1900 | Lewis |
| 696,995 | A | 4/1902 | Moser |
| 762,725 | A | 6/1904 | Kaufmann |
| 790,432 | A | 5/1905 | Heilrath |
| 857,459 | A | 6/1907 | Henrickson |
| 858,003 | A | 6/1907 | Klever |
| 881,294 | A | 3/1908 | Billings |
| 888,795 | A | 5/1908 | Fields |
| 896,746 | A | 8/1908 | McCarty |
| 948,231 | A | 2/1910 | Libby |

(List continued on next page.)

FOREIGN PATENT DOCUMENTS

| | | |
|---|---|---|
| CH | 277412 | 11/1951 |
| DE | 29556 | 4/1884 |
| DE | 30788 | 3/1885 |
| DE | 145784 | 7/1902 |
| DE | 2322229 | 5/1974 |
| DE | 91 03 496.5 U | 8/1991 |
| EP | 0 783 938 | 7/1997 |
| FR | 409943 | 5/1910 |
| FR | 2308470 | 11/1976 |
| GB | 17248 | 6/1896 |
| GB | 20299 | 11/1902 |
| GB | 13254 | 9/1905 |
| GB | 186520 | 10/1922 |
| GB | 403769 | 1/1934 |
| IT | 521555 | 3/1955 |
| RU | 1002145 | 3/1983 |

*Primary Examiner*—James G. Smith
(74) *Attorney, Agent, or Firm*—Joseph J. Previto

(57) ABSTRACT

A foldable multi-tool having a pair of jaws pivotally mounted to each other with each jaw having a head and a shank. A handle is pivotally mounted at one end to each of the shanks and foldable relative to the jaws along a first pivot pin. The handle has a hollow area comprising side walls, a bottom wall and an open top. The interior of the hollow area has a space to receive the jaws when the handles are folded relative to the jaws. The hollow area has a seat on which the jaws are seated when the jaws are in their folded position. The jaws have outer surfaces and the seats have an area which is contoured in a manner similar to the contour of the outer surfaces of the jaws.

6 Claims, 4 Drawing Sheets

U.S. PATENT DOCUMENTS 988,068 A 3/1911 Beardsley et al.
1,174,132 A 3/1916 Dragun
1,184,746 A 5/1916 Hanson
1,187,842 A 6/1916 Kaas
1,194,296 A 8/1916 Jones et al.
1,334,425 A 3/1920 Wernimont
1,370,906 A 3/1921 Newton
1,461,270 A 7/1923 Garrison
1,467,661 A 9/1923 Undy
1,472,826 A 11/1923 Champlin
1,474,592 A 11/1923 Jacoby
1,486,725 A 3/1924 Brown
1,511,340 A 10/1924 Jackson
1,524,694 A 2/1925 Di Maio
1,551,328 A 8/1925 Perry
1,561,833 A 11/1925 Cruickshank
1,561,993 A 11/1925 Nielsen
1,619,181 A 3/1927 Beretz
1,828,121 A 10/1931 Adam
2,057,201 A 10/1936 Mc Cluskey
D137,408 S 3/1944 Frisk
D149,934 S 6/1948 Cobb
2,514,130 A 7/1950 Jones
2,561,682 A 7/1951 Barnett
2,575,652 A 11/1951 Bovee
2,606,471 A 8/1952 Kollweck
2,641,149 A 6/1953 Petersen
2,714,249 A 8/1955 Clark et al.
2,747,446 A 5/1956 Eder
2,779,098 A 1/1957 Pocoski et al.
2,814,108 A 11/1957 Bassett
3,044,081 A 7/1962 Robinson, Jr.
3,364,508 A 1/1968 Garrett
3,798,687 A 3/1974 Stevens
3,858,258 A 1/1975 Stevens
3,947,905 A 4/1976 Neff
4,208,749 A 6/1980 Hermann et al.
4,238,862 A 12/1980 Leatherman
4,297,756 A 11/1981 Lance
4,330,937 A 5/1982 Cope
4,347,665 A 9/1982 Glesser
4,364,174 A 12/1982 De Asis
4,502,220 A 3/1985 Aoki
4,512,051 A 4/1985 Magan
4,555,822 A 12/1985 Miceli
4,563,833 A 1/1986 Aucoin
D286,501 S 11/1986 Magan
4,648,145 A 3/1987 Miceli
4,669,140 A 6/1987 Miceli
4,744,272 A 5/1988 Leatherman
4,805,303 A 2/1989 Gibbs
4,856,132 A 8/1989 Burns et al.
4,888,869 A 12/1989 Leatherman
4,896,424 A 1/1990 Walker
4,942,637 A 7/1990 Yeang-Yai
4,995,128 A 2/1991 Montgomery et al.
5,014,379 A 5/1991 Hull et al.
5,029,355 A 7/1991 Thai
5,044,079 A 9/1991 Gibbs
5,062,173 A 11/1991 Collins et al.
5,074,046 A 12/1991 Kolesky
5,119,520 A 6/1992 Finn
D327,826 S 7/1992 Neff
5,142,721 A 9/1992 Sessions et al.
5,157,996 A 10/1992 Keyvani
5,207,012 A 5/1993 Lael
5,212,844 A 5/1993 Sessions et al.
D338,386 S 8/1993 Frazer
5,245,721 A 9/1993 Lowe et al.
5,267,366 A 12/1993 Frazer
5,320,004 A 6/1994 Hsiao
D356,019 S 3/1995 Sakai
D365,266 S 12/1995 Hasegawa
5,491,856 A 2/1996 Legg
D367,807 S 3/1996 Hung
5,497,522 A 3/1996 Chen
D368,634 S 4/1996 Frazer
D371,498 S 7/1996 Lai
5,537,750 A 7/1996 Seber et al.
D382,182 S 8/1997 Seber et al.
D384,872 S 10/1997 Yeh
5,697,114 A 12/1997 McIntosh et al.
5,745,997 A 5/1998 Berg et al.
5,765,247 A 6/1998 Seber et al.
D407,286 S 3/1999 Seber et al.
D407,287 S 3/1999 Seber et al.
D407,616 S 4/1999 Seber
D410,833 S 6/1999 Hasegawa
5,964,131 A 10/1999 Seber et al.
5,996,451 A 12/1999 Seber et al.
6,006,385 A 12/1999 Kershaw et al.
6,047,426 A 4/2000 McIntosh et al.

FOLDABLE MULTI-TOOL

BACKGROUND

The present invention relates to hand tools and more particularly to foldable multi-tools such as foldable wrenches, pliers, etc.

Foldable multi-tools have been in use for a number of years. In general, they comprise two jaws pivoted together from which handles are pivotally mounted and extend rearwardly therefrom. The handles are foldable relative to the jaws from an open to a closed position. In some such tools, the handles are substantially hollow in order to permit the jaws to be folded therewithin. The handles may also have auxiliary tools pivotally mounted thereon which are closeable within the hollow handles. Many of these tools comprise complicated mechanisms for folding and unfolding them as well as opening and closing the auxiliary tools. Many of these tools are expensive to manufacture and assemble and are complicated to use.

OBJECTS

The present invention overcomes these defects and has for one of its objects the provision of an improved foldable multi-tool which is simple to use.

Another object of the present invention is the provision of an improved foldable multi-tool in which the jaws and handles can be easily folded and unfolded relative to each other.

Another object of the present invention is the provision of an improved foldable multi-tool in which auxiliary tools are pivotally mounted in the handles and which may be easily opened and closed relative to the handles.

Another object of the present invention is the provision of an improved foldable multi-tool in which the jaws may be easily folded with the hollow handles.

Another object of the present invention is the provision of an improved foldable multi-tool in which the jaws may be folded into the handles to form a compact unit.

Another object of the present invention is the provision of an improved foldable multi-tool which is simple and inexpensive to manufacture and assemble.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for the purposes of illustration and description and is shown in the accompanying drawings forming a part of the specification, wherein.

DESCRIPTION

Figure 1:
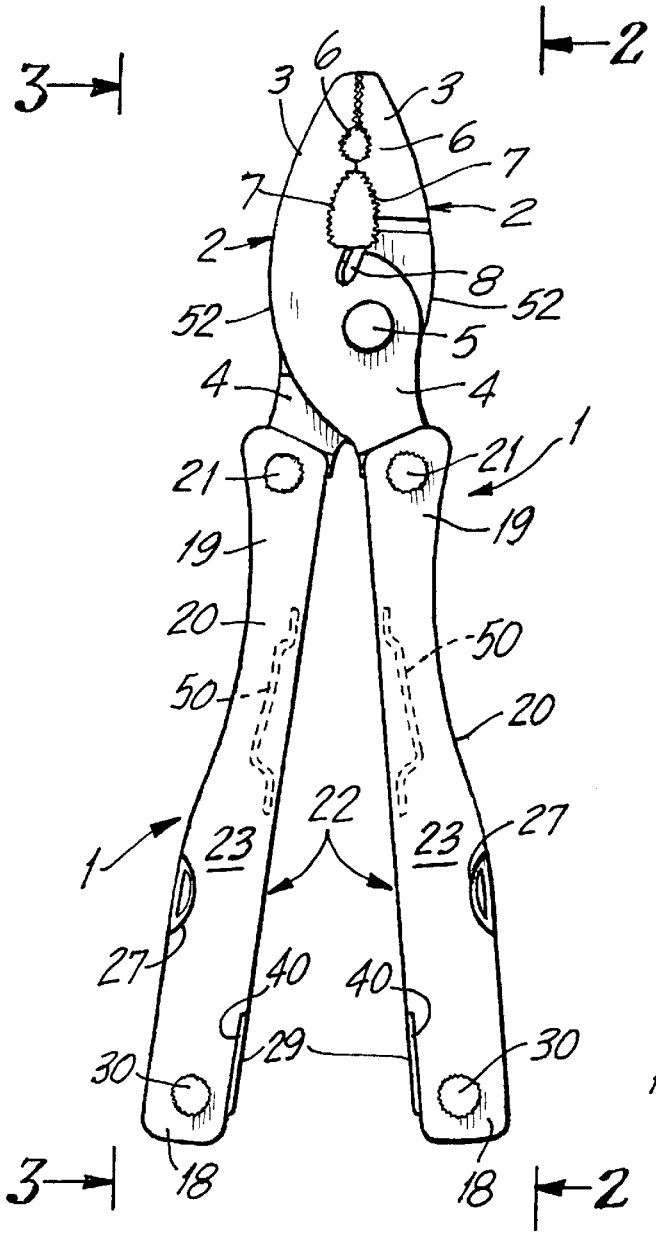
FIG. 1 is a plan view of one side of a foldable multi-tool made in accordance with the present invention.

Referring to the drawings, the tool 1 of the present invention comprises a pair of jaws 2 each having a head 3 and a shank 4 and pivoted to each other on pivot pin 5. The jaws 2 pivot from an unfolded position to a folded position around the pivot pin 5. In the drawings, the jaws 2 are shown as being substantially similar to each other with each head 3 having teeth 6 and 7 and cutter notches 8 for cutting wire and the like. However, it will be understood that the tool of the present invention may have pivoted members other than the jaws 2 shown in the drawing, such as scissors, blades and the like, without departing from the invention. The shank 4 of one of the jaws 2 has an elongated slip slot 9 within which the pivot pin 5 slides to permit the jaws to slip toward and away from each other.

Extending rearwardly from each shark 4 is a hollow handle 20 which is pivotally mounted at its inner end 19 to shank 4 around pivot pin 21 and is moveable from a folded position to an unfolded position. Each handle 20 comprises a bottom wall 22 and a pair of upstanding side walls 23 and 24 at right angles to and extending from said bottom wall 22. The top 17 of each hollow handle 20 opposite bottom wall 22 is substantially open. Finger notches 27 and 28 may be formed on the side walls 23 and 24, respectively.

Figure 2:
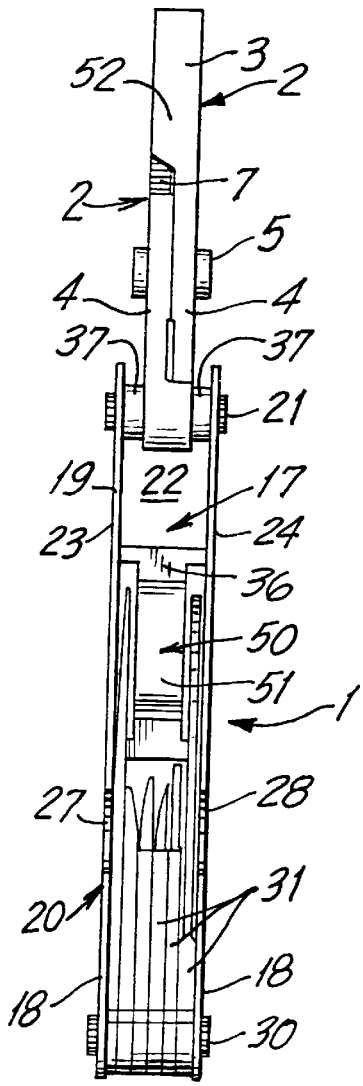
FIG. 2 is a view taken along line 2—2 of FIG. 1.
Figure 3:
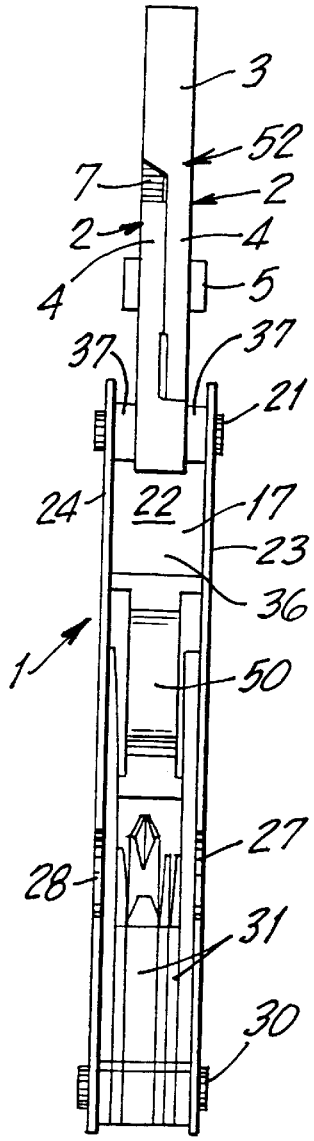
FIG. 3 is a view taken along line 3—3 of FIG. 1.
Figure 4:
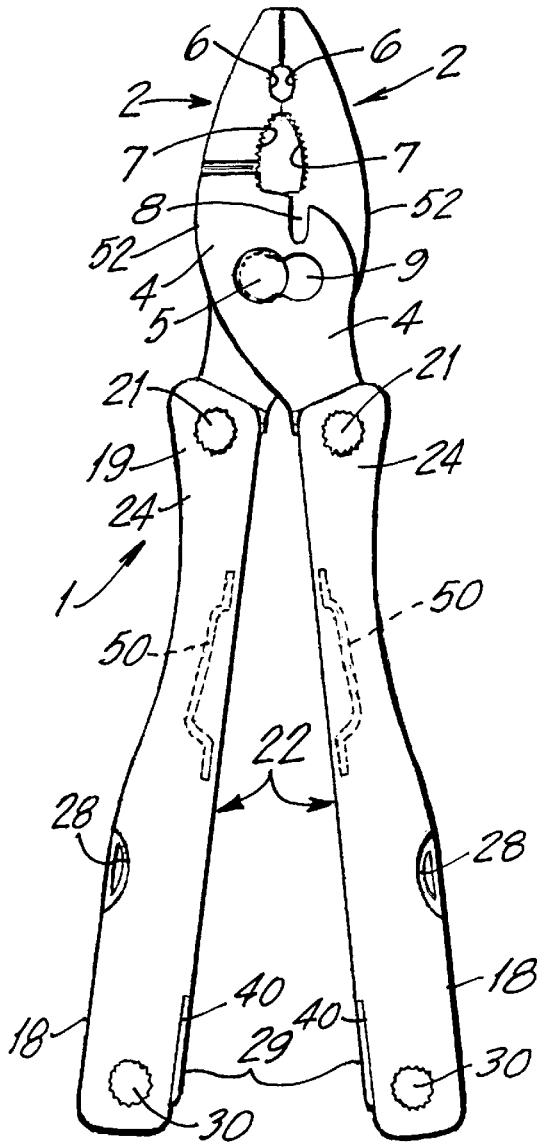
FIG. 4 is a plan view of the other side of the foldable multi-tool.
Figure 5:
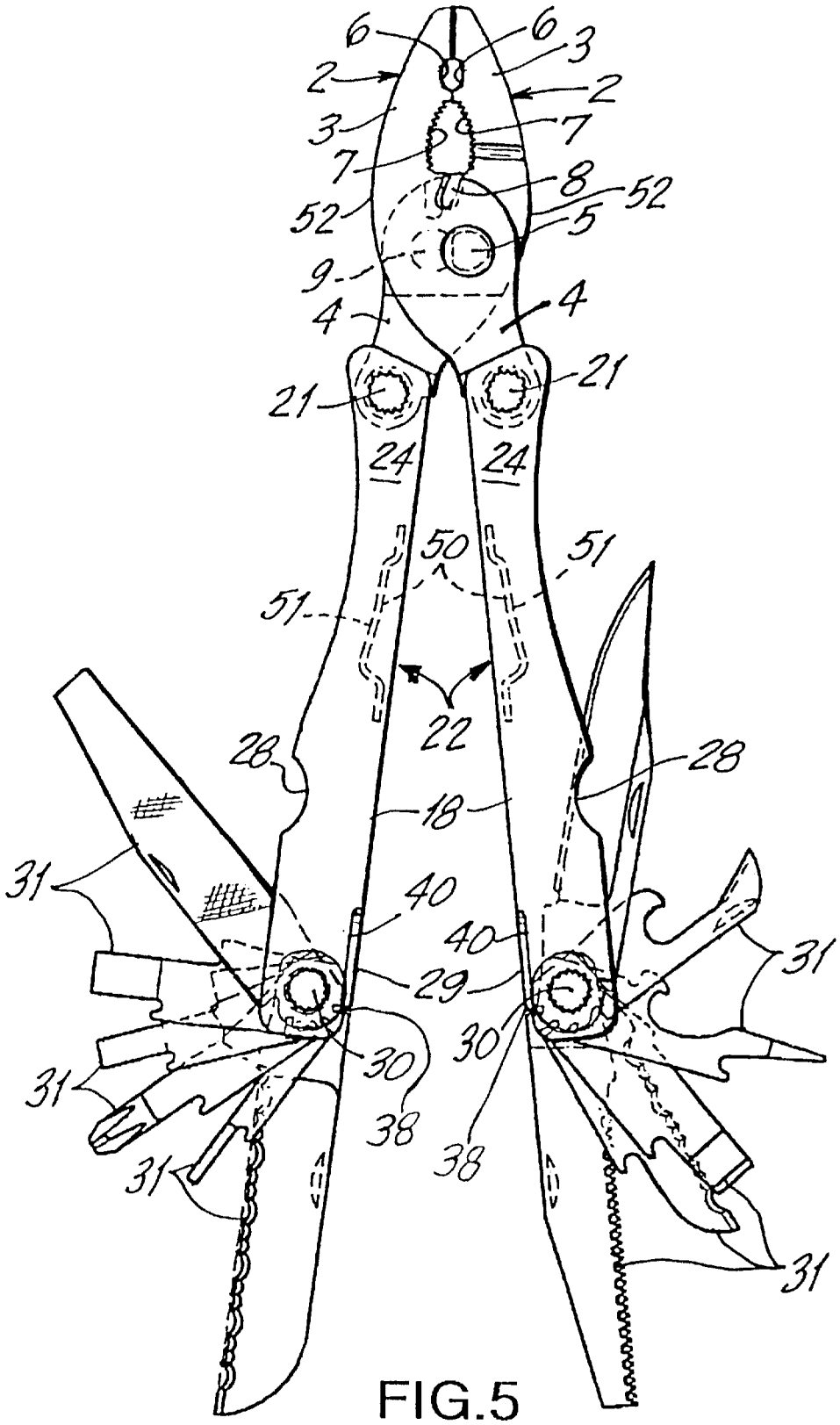
FIG. 5 is a plan view showing the foldable multi-tool in its unfolded position with auxiliary tools shown in a partly open position.
Figure 6:
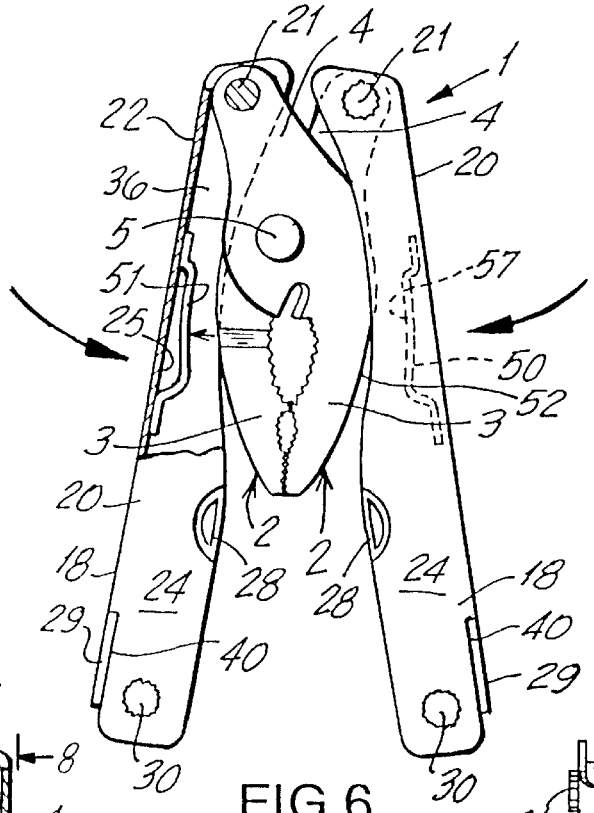
FIG. 6 is a plan view showing the tool in the process of being folded.
Figure 7:
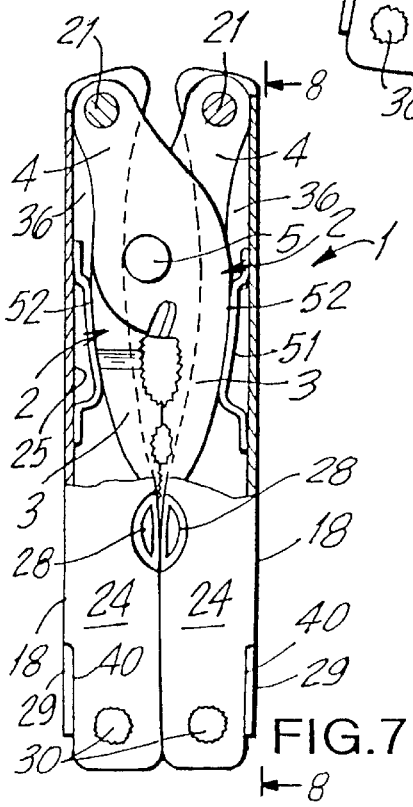
FIG. 7 is a plan view showing the tool in its folded position.
Figure 8:
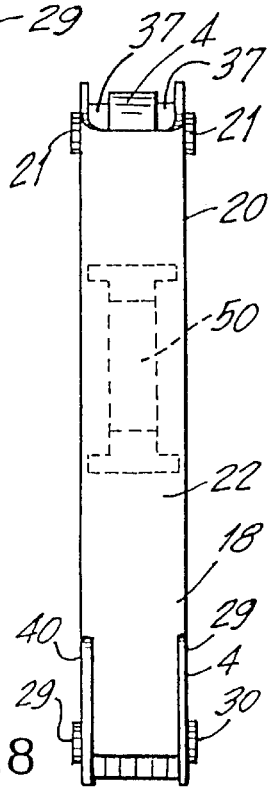
FIG. 8 is a view taken along line 8—8 of FIG. 7.

At the outer end 18 of each handle 20 and opposite the pivot pin 21, a pivot pin 30 is provided on which a plurality of auxiliary tools 31 are pivotally mounted. The auxiliary tools 31 may comprise knives, saws, screwdrivers, scissors, and the like. The auxiliary tools 31 are individually pivotable from a closed position within the sidewalls 23–24 of each hollow handle 20 (FIGS. 2 and 4) to an open position extending beyond the open top 17 of the hollow handle 20 (FIG. 5). These auxiliary tools 31 are positioned in side-by-side relationship between and within the side walls 23–24 of each handle 20. The rear end of the bottom wall 22 of each hollow handle 20 has slits 40 where the bottom wall 22 and side walls 23–24 meet to form a lock spring 29 as an extension of and on the same plane as bottom wall 22 with its end edge 38 curved inwardly forming a locking edge. The function of this lock spring 29 is described in said pending application Ser. No. 09/594,018, the description of which is incorporated herein by reference, so that its function will not be repeated here. The open top 17 of each handle will face outwardly when the tool is unfolded and will face each other when the tool is folded. Hence, the auxiliary tools 31 may be opened and used when the tool is in its unfolded position. However when the tool is in its folded position, the auxiliary tools 31 will face each other and will be unable to be opened and used.

The inner end 19 of the hollow handles 20 has a space 36 devoid of any auxiliary tool 31 to receive and accommodate the jaws 2 when the tool is in its folded position. Spacers 37 may be provided around pivot 21 to keep the shanks 4 and heads 3 of the jaws 2 substantially centered and away from the side walls 23–24 of the hollow handle 20 so that, when fully folded, the jaws 2 will fit into the space 36 and will lie between side walls 23–24. The inner surface 25 of the bottom wall 22 has a seat 50 provided therein which may be curved, or otherwise contoured, which conforms to the curve or contour of the outer surfaces 52 of the jaws 2. Hence, when the jaws 2 are folded within hollow handle 20, the outer surfaces 52 of the jaws 2 will sit on these seats 50 to form a compact folded tool.

When the tool is to be used, the tool is unfolded by pivoting the handles around pivot 21 as shown in FIG. 1. In this position, the auxiliary tools 31 may be opened and used, when desired, by moving them around pivot 30. When it is desired to fold the tool 1, all open auxiliary tools 31 are closed by moving them around pivot 30 and placing them within the hollow handles 20. The jaws 2 are folded around pivot 21 to rest within hollow handles 20 with their outer surfaces 52 seated on the contoured surfaces 51 of the seats 50. Since the contour surfaces 51 of the seats 50 conform to the contours of outer surfaces 52 of jaws 2, the folded tool will be folded into a compact unit.

It will thus be seen that the present invention provides an improved foldable hand tool which is simple to use, which may be easily folded and unfolded, in which the various auxiliary tools can be easily opened and closed, which may easily be folded to a compact condition and which is simple and inexpensive to manufacture and assemble.

As many and varied modifications of the subject matter of this invention will become apparent to those skilled in the art from the detailed description given hereinabove, it will be understood that the present invention is limited only as provided in the claims appended hereto.

What is claimed is:

1. A foldable multi-tool comprising a pair of jaws pivotally mounted to each other, each jaw having a head and a shank, a hollow handle pivotally mounted at one end thereof to each of said shanks and foldable relative to said jaws along a first pivot pin, said hollow handle comprising side walls, a bottom wall and an open top, the interior of said hollow handle forming a space between said side walls and said bottom wall to receive at least a portion of said jaws when the handles are folded relative to the jaws, the open tops of said hollow handles facing each other when the jaws are in their folded position, said hollow handle having a seat on which the jaws are seated when the jaws are in their folded position, said seat being mounted on and permanently attached to said bottom wall and being stationary with respect thereto, said seat being rigid and having a raised portion spaced above said bottom wall, each of said jaws have an outer surface and said portion being contoured in a manner similar to the contour of the outer surface of each of said jaws, said outer surface being seated on top of said raised portion of said rigid seat when the jaws are in their folded position.

2. A foldable multi-tool as set forth in claim 1 wherein at least one auxiliary tool is pivotally mounted within at least one of said hollow handles along a second pivot pin.

3. A foldable multi-tool as set forth in claim 2 wherein said first pivot pin is at one end of said handle and wherein said second pivot pin is at the other end of said handle.

4. A foldable tool as set forth in claim 3 wherein each of said seats is located adjacent said first pivot pin.

5. A foldable multi-tool comprising a pair of jaws pivotally mounted to each other, each jaw having a head and a shank, a handle pivotally mounted at one end thereof to each of said shanks and foldable relative to said jaws along a first pivot pin, said handle having a hollow area comprising side walls, a bottom wall and an open top, the interior of said hollow area forming a space to receive at least a portion of said jaws when the handles are folded relative to the jaws, said hollow are having a seat on which the jaws are seated and when the jaws are in their folded position, said seat being mounted on and attached to said bottom wall and being stationary with respect thereto, said jaws have outer surfaces and said seats have an area which is contoured in a manner similar to the contour of the outer surfaces of said jaws, said handles are hollow, at least one auxiliary tool is pivotally mounted within at least one of said hollow handles along a second pivot pin, said first pivot pin is at one end of said handle and wherein said second pivot pin is at the other end of said handle, each of said seats is located adjacent said first pivot pin, and wherein spacer means are provided on said first pivot pin in each handle to center the jaws within the handle when the jaws are in their folded position.

6. A foldable multi-tool as set forth in claim 4, wherein spacer means are provided on said first pivot pin in each handle to center the jaws within the handle when the jaws are in their folded position.

* * * * *